United States Patent [19]

Tissot

[11] Patent Number: 4,573,453

[45] Date of Patent: Mar. 4, 1986

[54] PRESSURE THERAPY APPARATUS

[76] Inventor: Jean Tissot, 26, Avenue Carnot, 91310 Verrieres Le Bousson, France

[21] Appl. No.: 621,432

[22] Filed: Jun. 18, 1984

[30] Foreign Application Priority Data

Jun. 16, 1983 [FR] France ..... 83 09957

[51] Int. Cl.[4] ..... A61H 7/00

[52] U.S. Cl. ..... 128/64; 128/39; 128/24 R

[58] Field of Search ..... 128/24 R, 38, 39, 64, 128/DIG. 20

[56] References Cited

U.S. PATENT DOCUMENTS

| | | | |
|---|---|---|---|
| 2,531,074 | 11/1950 | Miller | 128/64 X |
| 2,659,593 | 5/1972 | Vail | 128/64 |
| 3,454,010 | 7/1969 | Lilligren et al. | 128/24 R X |
| 4,253,449 | 3/1981 | Arkans et al. | 128/14 R |
| 4,338,923 | 7/1982 | Gelfer et al. | 128/24 R |
| 4,374,518 | 2/1983 | Villanueva | 128/64 |

FOREIGN PATENT DOCUMENTS

| | | | |
|---|---|---|---|
| 440113 | 2/1927 | Fed. Rep. of Germany | 128/DIG. 20 |
| 2246260 | 5/1975 | France | 128/24 R |
| 2511241 | 2/1983 | France | 128/64 |

*Primary Examiner*—Richard J. Apley
*Assistant Examiner*—David J. Brown
*Attorney, Agent, or Firm*—Darby & Darby

[57] ABSTRACT

A pneumatic massage apparatus adapted for pressotherapy includes an inflatable sleeve having inner and outer sheaths, and lateral partition walls extending between the inner and outer sheaths. The inner and outer sheaths are formed of an air-impermeable, non-elastic material, and the lateral partition walls are formed of a flexible air-impermeable, non-elastic material. The partition walls and inner and outer sheaths define separate inflatable chambers, adjacent chambers being separated by a partition wall. The length of each of the partition walls, measured between the inner and outer sheaths, is greater than the distance between the inner and outer sheaths.

5 Claims, 5 Drawing Figures

PRESSURE THERAPY APPARATUS

BACKGROUND OF THE INVENTION

1. Field of the Invention

The present invention relates to automatic pneumatic massage apparatus of the type which has at least one inflatable sleeve which covers a part of the body of a patient, generally a limb, which is placed rhythmically under pressure, the technique being commonly known as "pressotherapy."

A pressotherapy apparatus comprises two separate parts:

First of all, the generator or apparatus proper, provided with means for producing compressed air (compressor) and distributing it (valves or distributor); means for regulating the pressure and checking it (regulator and pressure gauge); means for regulating the time of compression and rest and the duration of the application.

Secondly, the compression elements, also known as the massage elements, connected by tubes to the generator and which, for the sake of convenience, we will refer to as "sleeves." The sleeve is placed alternately under pressure, which time we will refer to as work or compression, and then in communication with the open air, which time we will refer to as rest or decompression.

2. Description of the Related Art

There are two types of sleeves. In the first case, the outer sheath forming cover, which represents the maximum volume to be placed under pressure, and the inner cover which applies the pressure to the surface of the limb treated, define only a single inflatable hollow volume; in this case, one speaks of a mono-cavity or single-enclosure sleeve and of non-staged pressotherapy. In the second case, the sleeve is divided into a plurality of volumes or cells or enclosures which are independent and are placed successively under pressure in accordance with different methods. In this case one speaks of a multi-cell sleeve and of staged pressotherapy. Of course, the distribution means are designed as a function of the type of sleeve used and the number of independent enclosures which it may comprise.

In general, applications are effected with a single sleeve, or with a pair of sleeves in the event that two limbs are treated at the same time. When the sleeves are used in pairs, they can be placed under pressure:

either simultaneously: in this case, the distribution of the compressed air is practically identical to that which would be present with a single sleeve, since it is sufficient to double the outlet orifice or orifices;

or alternately: in this case, while one sleeve is placed under pressure the other sleeve is in communication with the open air, that is to say at rest. Therefore the period of rest is, in principle, equal to the period of compression.

The main object of pressotherapy is to remedy insufficiencies in return circulation (vein and/or lymphatic circulation) and/or problems of liquid stasis (for instance, edema).

The quality of the results obtained depends on various parameters, namely:

the pressure: too low a pressure will act only on the surface vessels and not on the sub-aponeurotic deep vessels, or on the liquid stasis of an old fibrosed edema, for instance;

the frequency: (that is to say, the number of pressurizings per unit of time). A pressurizing which lasts too long cannot constitute a factor for accelerating the return circulatory flow but rather constitutes a restriction thereon. These two parameters are in direct relationship to the amount of compressed air generated;

the progressiveness of the compressions. With the sleeve technique one can, of course, only contemplate compression by successive portions. As the object is to assist the mass of liquid (free or circulating) in its return trip to the heart, it seems logical to desire the compression to be established in this same direction, that is to say from the end of the limb towards its root, the so-called distal/proximal direction, and also that the pressure be stronger at the end.

The pressotherapy apparatus used at the present time do not satisfy all these criteria.

OBJECT AND SUMMARY OF THE INVENTION

The object of the present invention is the combination of a compressed air distributor and a pressotherapy sleeve comprising a plurality of cells, the distributor being provided with means which make it possible to close the feed channel of each cell after it has been inflated so as to isolate it from the other cells during the pressurization, and the sleeve comprising a plurality of flexible but non-elastic partitions whose length is greater than the distance between the two sheaths forming the sleeve. Thus, when a first cell has been inflated its feed conduit is closed but the following cell is inflated in its turn to the same feed pressure, which causes a deformation of the walls of the first and a slight increase in the internal pressure in this first cell and thus, step by step, with the same feed pressure, the appearance of a pressure gradient, the first inflated cell having an internal pressure which is slightly greater than the second cell, which in its turn has an internal pressure which is slightly greater than the following one, and so on.

Due to this arrangement, one can therefore, with a source of compressed air at constant predetermined pressure, that is to say with a single pressure regulator, obtain a pressotherapy sleeve having cells inflated with a pressure gradient which decreases from the first to the last, which up to now was possible only by employing a pressure regulator for each cell, which is a very costly solution and takes up a large amount of space.

BRIEF DESCRIPTION OF THE DRAWING

By way of illustration and not of limitation and in order to facilitate an understanding of the invention, in the accompanying drawings.

DESCRIPTION OF THE PREFERRED EMBODIMENTS

Figure 1:
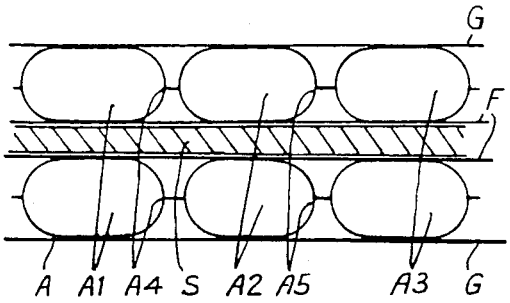
FIGS. 1 and 2 show two known sleeve assemblies.

FIG. 1 shows diagrammatically a sleeve A, divided into three independent enclosures A1, A2, A3 by means of two gluings A4 and A5 between the two sheaths which form it, the sheath F being the inner sheath forming a lining in contact with the limb to be treated and the non-stretchable sheath G defining the maximum volume of the sleeve.

A limb segment S is inserted into the sleeve A. It would appear obvious that with this manner of division none of the three enclosures can have any action on any other of the enclosures which form the sleeve. They are absolutely independent.

In a second case, the multi-cell sleeve is formed from a sheath of sewn cloth, into which independent inflatable pockets are inserted. The outer wall G corresponds to what was previously called the outer sheath and the inner wall F to what was called the inner sheath.

Figure 2:
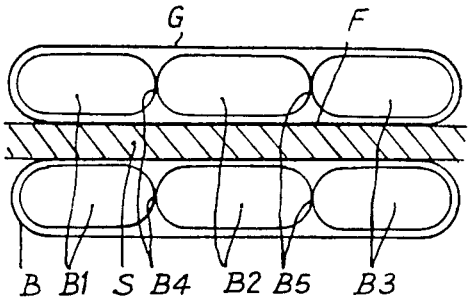

FIG. 2 shows a cloth sleeve B covering a limb segment S into which three inflatable pockets B1, B2, B3 have been slipped which, when inflated, adjoin each other at B4 and B5. When placed under pressure, the pocket B1 first of all occupies its space. The pocket B2 then does the same. It is only when B3 is placed under pressure that the cloth sheath will be completely filled and the three pockets will adjoin each other at B4 and B5, but they will all have substantially the same pressure.

In the third case, the division into independent enclosures is effected by means of transverse partitions connecting the inner sheath F of the sleeve to its outer sheath G, the width of these partitions being definitely greater than the distance between the two sheaths G and F when they are in use.

Figure 3:
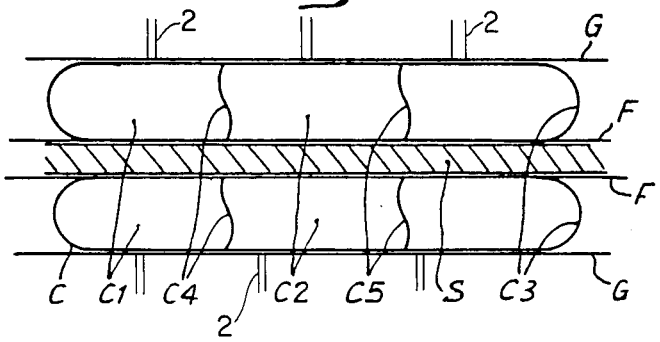
FIG. 3 is a diagrammatic view of a sleeve according to the present invention.

FIG. 3 shows a sleeve C which covers a portion of limb S and is divided into three separately inflatable enclosures C1, C2, C3 by two partitions C4 and C5 of sufficient width which connect the inner sheath F to the outer sheath G. This manner of procedure makes it possible to establish a homogeneous unit manufactured from a flexible, airtight and particularly non-elastic material, preferably a coated fabric. The enclosure C1 is placed under a pressure "p" which is the pressure determined by the pressure regulator of the apparatus. The feed conduit of enclosure C1 is then closed at the location of the distributor and the enclosure C2 is then inflated to the pressure "p". While the pressure rises in the enclosure C2, the compressed air exerts on partition C4 an increasing pressure in the direction of C1, the air not being able to escape from the latter since this enclosure is isolated. The pressure of C1 therefore increases to above its initial value "p." In the same way, the isolating of C2 and the pressurizing of C3 serve to increase the pressure in C2, which is transmitted again to C1. The final pressure in the three enclosures will therefore be as follows: If "p1" is the pressure in C1, "p2" the pressure in C2 and "p3" the pressure C3, it being pointed out that "p3" is equal to "p," the pressure determined by the regulator, the different pressures will be as follows:

$$\text{"p1"} > \text{"p2"} > \text{"p3"} = \text{"p"}.$$

With a sleeve comprising a number "n" of enclosures, one will have:

$$\text{"p1"} > \text{"p2"} > \text{"p3"} > \text{"p4"} \ldots > \text{"pn"} = \text{"p"}$$

the last enclosure of the sleeve being always at the pressure determined by the regulator. This phenomenon has been verified by placing a pressure gauge in parallel on each of the enclosures which constitute the sleeve.

For this purpose, the compressed air distributor has a pressure regulator which can be regulated as desired so as to obtain a constant, predetermined pressure and a group of closure means, one for each feed conduit 2 connected to a cell, which when the corresponding cell has been inflated to the desired pressure, closes the conduit 2 so that the inflated cells cannot communicate with each other, and which opens the conduit 2 to allow each cell to be deflated.

Thus the combination of means consisting of the use of a distributor adapted to isolate the enclosures after the pressurizing of each of them and of a sleeve the division of which into independent enclosures is effected by means of internal partitions which are integral with the sheaths which constitute them, the width of these partitions being substantially greater than the distance between the two sheaths G and F when they are in use, makes it possible to create a pressure gradient between the different enclosures of the sleeve in such a manner that, in logical fashion, the limb treated is compressed more strongly at its end than at its root. This improvement has never been used up to now in apparatus having only a single pressure regulator.

The apparatus of the invention combines a compressed air distributor provided with a single pressure regulator and having means making it possible to close off the feed of each cell when it has been inflated to the desired pressure so as to isolate the cells from each other, and a sleeve whose partition walls are flexible so that the inflation of each cell causes a decrease in the volume of the adjacent cell which has been previously inflated and therefore a slight increase in the pressure in the latter. One thus obtains a pressure gradient while having only a single pressure regulator.

Figure 4:
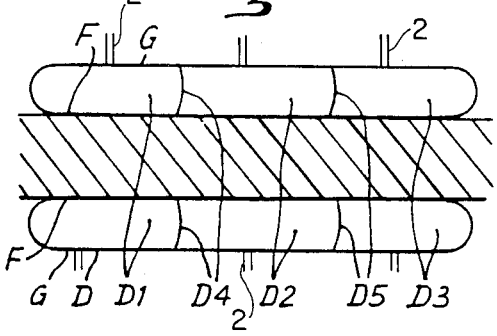
FIGS. 4 and 5 are two diagrammatic views of variants of the embodiment of FIG. 3.
Figure 5:
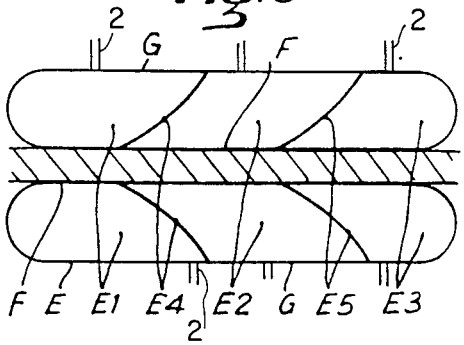

However, it is also possible to predetermine the value of the pressure gradient thus obtained. As a matter of fact, the increase of the pressure in an isolated enclosure will be proportional to the force exerted by the partition which separates it from the adjoining enclosure. For a greater increase in pressure a larger force is required. Since the pressure does not change—as it is the pressure which is determined by the regulator—in order to increase the force it is sufficient to increase the surface on which the pressure acts proportionally to the total. Thus it is possible to constitute sleeves of low pressure gradient by means of partitions of small area and therefore of reduced width. On the other hand, the value of the gradient will be increased by means of partitions of large area and therefore ones which are very wide. FIG. 4 diagrammatically shows a sleeve D having three enclosures D1, D2 and D3 with short partitions D4 and D5, which will produce only a slight pressure gradient. As shown in FIG. 4, the lines of connection of the partitions to the inner and outer sheaths are arranged one above the other. FIG. 5 shows a sleeve E divided into three partitions E1, E2 and E3 by means of wide partitions E4 and E5 capable of determining a larger pressure gradient. As shown in FIG. 5, the lines of connection of the partitions to the inner and outer sheaths are offset laterally with respect to each other. The cells may have equal volumes and may be separating partitions of equal dimensions so that the pressure gradient is uniform. Alternatively, the cells may have different volumes and may be separated by partitions of different dimensions so that the pressure gradient is variable. It is even possible to form sleeves the value of the gradient of which will differ depending on the level in question, by introducing partitions of different width.

An apparatus according to the invention is characterized by the fact that the value of the pressure gradient can be predetermined as a function of the area of the partitions which divide the sleeve into independent enclosures.

The various improvements contemplated above may be employed individually or jointly, depending on the purpose in view and the apparatus to be designed, that is to say the use of only one or several sleeves—simultaneous or alternate pressurizing in the case of two sleeves—and according to the number of enclosures (at least two or more).

I claim:

1. A pneumatic massage apparatus adapted for pressotherapy, which comprises:

an inflatable sleeve, the sleeve including first and second longitudinal walls, and lateral partition walls extending between the first and second longitudinal walls and joined thereto, the first and second longitudinal walls being formed of a gas impermeable, non-elastic material, the partition walls being formed of a flexible, gas impermeable, non-elastic material, the partition walls and first and second longitudinal walls defining therebetween separate inflatable chambers, inflation means on said sleeve for individually inflating each of said chambers, adjacent chambers being separated by a respective one of the partition walls, the length of each of the partition walls being greater than the distance between the first and second longitudinal walls wherein the inflation of one of the chambers at a gas pressure P causes the partition walls to extend laterally and upon inflation of the next chamber at the same gas pressure P, the previously laterally extended partition wall laterally contracts due to the increased pressure in said next chamber thereby increasing the gas pressure in the previously inflated chamber.

2. Apparatus as defined in claim 1, wherein each of the chambers defined by the first and second longitudinal walls and the partition walls have equal volumes; and wherein each of the partition walls have equal lengths.

3. Apparatus as defined by claim 1, wherein at least two of the chambers defined by the first and second longitudinal walls and the partition walls have different volumes; and wherein at least two of the partition walls have different lengths.

4. Apparatus as defined by claim 1, wherein the points at which each of the partition walls is joined to the first longitudinal wall are offset laterally from the points at which said each of the partition walls is joined to the second longitudinal wall.

5. Apparatus as defined by claim 1, wherein the points at which each of the partition walls is joined to the first longitudinal wall is transversely opposite to the points at which said each of the partition walls is joined to the second longitudinal wall.

* * * * *